US007371188B2

(12) United States Patent
Chen

(10) Patent No.: US 7,371,188 B2
(45) Date of Patent: May 13, 2008

(54) GOLF CLUB HEAD HAVING A CONNECTING STRUCTURE FOR A HIGH DEGREE OF FLEXIBILITY

(75) Inventor: Chan-Tung Chen, Kaohsiung (TW)

(73) Assignee: Nelson Precision Casting Co., Ltd., Kaohsiung (TW)

( * ) Notice: Subject to any disclaimer, the term of this patent is extended or adjusted under 35 U.S.C. 154(b) by 225 days.

(21) Appl. No.: 11/168,430

(22) Filed: Jun. 29, 2005

(65) Prior Publication Data

US 2006/0252575 A1 Nov. 9, 2006

(30) Foreign Application Priority Data

May 3, 2005 (TW) ..... 94114246 A

(51) Int. Cl.
*A63B 53/04* (2006.01)

(52) U.S. Cl. ..... 473/329; 473/342; 473/345; 473/349; 473/350

(58) Field of Classification Search ..... 473/324–350, 473/287–291, 219–256
See application file for complete search history.

(56) References Cited

U.S. PATENT DOCUMENTS 1,359,220 A * 11/1920 Beamer ..... 473/329
3,387,844 A * 6/1968 Shippee ..... 473/329
4,021,047 A * 5/1977 Mader ..... 473/345
4,438,931 A * 3/1984 Motomiya ..... 473/346
4,749,197 A * 6/1988 Orlowski ..... 473/342
5,176,384 A * 1/1993 Sata et al. ..... 473/329
5,509,660 A * 4/1996 Elmer ..... 473/288
5,522,593 A * 6/1996 Kobayashi et al. ..... 473/349
6,050,904 A * 4/2000 Kuo ..... 473/342
6,099,414 A 8/2000 Kusano et al.
6,348,013 B1 * 2/2002 Kosmatka ..... 473/329
6,443,857 B1 * 9/2002 Chuang ..... 473/332
6,506,129 B2 1/2003 Chen
6,607,451 B2 * 8/2003 Kosmatka et al. ..... 473/329
6,648,774 B1 * 11/2003 Lee ..... 473/342
6,743,120 B1 6/2004 Chen
6,746,342 B1 * 6/2004 Hsieh ..... 473/342
6,841,014 B2 * 1/2005 Huang et al. ..... 148/608
6,875,126 B2 * 4/2005 Yabu ..... 473/305
6,971,961 B2 * 12/2005 Chen ..... 473/342
2004/0097301 A1 5/2004 Lee
2004/0226160 A1 * 11/2004 Sano ..... 29/527.5
2004/0266548 A1 * 12/2004 Cheng et al. ..... 473/342
2005/0079927 A1 * 4/2005 Chen ..... 473/345
2005/0090331 A1 * 4/2005 Oyama ..... 473/345
2006/0030424 A1 * 2/2006 Su ..... 473/342
2006/0073912 A1 * 4/2006 Hsieh et al. ..... 473/350

(Continued)

*Primary Examiner*—Sebastiano Passaniti
(74) *Attorney, Agent, or Firm*—Muncy, Geissler, Olds & Lowe, PLLC

(57) ABSTRACT

A golf club head includes a striking plate component and a rear-assembling component mechanically connected thereto. The striking plate component provides with a striking face and a rear-connecting wall. The rear-connecting wall is bent rearward and extended a rearward extended length from the striking face. The rear-assembling component provides with a sidewall corresponding to the rear-connecting wall of the striking plate component. In assembling, the rear-connecting wall of the striking plate component connects with the sidewall of the rear-assembling component by means of an upstanding bent edge or a rear-assembling flange such that the rear-connecting wall separates the striking face from the rear-assembling component for permitting elastic deformation.

23 Claims, 7 Drawing Sheets

U.S. PATENT DOCUMENTS

2006/0135285 A1* 6/2006 Hou et al. ..... 473/342
2006/0154743 A1* 7/2006 Huang et al. ..... 473/345
2006/0252576 A1* 11/2006 Lo ..... 473/342
2006/0293119 A1* 12/2006 Hou ..... 473/342
2007/0178990 A1* 8/2007 Tsai ..... 473/345

* cited by examiner

GOLF CLUB HEAD HAVING A CONNECTING STRUCTURE FOR A HIGH DEGREE OF FLEXIBILITY

BACKGROUND OF THE INVENTION

1. Field of the Invention

The present invention relates to a golf club head having a connecting structure for a high degree of flexibility. Particularly, the present invention relates to the golf club head having a rear-connecting wall of a striking plate component to connect with a rear-assembling component. More particularly, the present invention relates to the rear-connecting wall of the striking plate component of the golf club head separating a striking face from the rear-assembling component.

2. Description of the Related Art

A conventional golf club head structure is described in Taiwanese Patent Publication No. 557,806 and corresponding U.S. Pat. No. 6,506,129, entitled "golf club head capable of enlarging flexible area of ball-hitting face thereof." Referring to FIGS. 1 and 2, the golf club head structure includes a club head body portion 10 and a striking plate portion 20 mechanically connected thereto. The club head body portion 10 has a toe portion 11, a heel portion 12, a crown portion 13, a sole portion 14, a front portion 15 and a front assembling portion 16. The front assembling portion 16 of the club head body portion 10 is formed on the front portion 15. The striking plate portion 20 has a striking face 21 and an annular wall 22. The annular wall 22 is substantially bent rearward from the striking face 21 so that a cross section of the striking plate portion 20 has a U-shaped configuration. In assembling, the annular wall 22 of the striking plate portion 20 is connected with the front assembling portion 16 of the club head body portion 10 by welding or brazing. Consequently, the club head body portion 10 and the striking plate portion 20 constitute a golf club head after assembling.

The front annular wall 22 of the striking plate portion 20 serves to perform the elastic deformation of the striking plate portion 20 while striking a golf ball (not shown). Consequently, the golf club head performs a good striking ability in striking a golf ball since the annular wall 22 of the striking plate portion 20 permits an adequate elastic deformation of the striking face 21 of the striking plate portion 20.

However, the assembled relationship of the golf club head disclosed in U.S. Pat. No. 6,506,129 has several drawbacks. For example, dimensions of the sole portion 14 of the club head body portion 10 is generally greater than that of the crown portion 13 so as to lower a center-of-gravity of the golf club head. As dimensions of the crown portion 13 of the club head body portion 10 is reduced, a length of the crown portion 13 in relation to a lengthwise direction substantially becomes shorter. Concretely, as a length of the crown portion 13 in relation to a lengthwise direction is reduced, a length of the annular wall 22 of the striking plate portion 20 in relation to a lengthwise direction synchronously becomes shorter. Disadvantageously, a shorter length of the annular wall 22 of the striking plate portion 20 may cause a low degree of flexibility in elastic deformation. In other words, an area of the annular wall 22 of the striking plate portion 20 for performing deformation ability is disadvantageously limited. Furthermore, a connecting area between the front assembling portion 16 of the club head body portion 10 and the annular wall 22 of the striking plate portion 20 is expanded so that the performance of elastic deformation of the striking plate portion 20 may be specifically affected.

Such a golf club head structure is widely applied in U.S. Pat. No. 6,099,414, entitled "Golf Club Head and Method for Producing the Same," U.S. Pat. No. 6,743,120, entitled "Iron Golf Club Head," and U.S. Publication No. 2004/0097301, entitled "Golf Club Head." As has been discussed above, a number of design limitations, however, exist for the annular wall of the striking plate portion due to difficulties in manufacturing. Such unwanted design limitations may alleviate the improvement of the striking ability contributed from the annular wall of the striking plate portion. Accordingly, the striking ability of the annular wall of the striking plate portion cannot be arrived at an expectation. In consideration of the above drawbacks, there is a need for modifying the conventional structure of the golf club head.

The present invention intends to provide a golf club head having a connecting structure for a high degree of flexibility, wherein a rear-connecting wall of a striking plate component to connect with a rear-assembling component. In assembling, an assembling end edge of the rear-connecting wall of the striking plate component connects with a sidewall of the rear-assembling component in such a way to mitigate and overcome the above problem.

SUMMARY OF THE INVENTION

The primary objective of this invention is to provide a golf club head having a connecting structure for a high degree of flexibility, wherein an upstanding bent edge of a rear-connecting wall of a striking plate component connects with a sidewall of a rear-assembling component. Accordingly, the rear-connecting wall of the striking plate component separates a striking face from the rear-assembling component such that a rearward extended length of the rear-connecting wall is enlarged and elastic deformation of the rear-connecting wall is enhanced.

The secondary objective of this invention is to provide the golf club head having a rear-assembling flange of the rear-assembling component to connect with the upstanding bent edge of the rear-connecting wall of the striking plate component. Accordingly, the rear-assembling flange of the rear-assembling component further separates the striking face from the rear-assembling component such that a rearward extended length of the rear-connecting wall is enlarged and elastic deformation of the rear-connecting wall is enhanced.

Another objective of this invention is to provide the golf club head having an inner circumference of the rear-connecting wall of the striking plate component connects with the rear-assembling flange of the rear-assembling component. Accordingly, the rear-assembling flange of the rear-assembling component improves an engagement of the striking plate component with the rear-assembling component such that an assembled reliability is insured.

Another objective of this invention is to provide the golf club head having an engaging stepped end of the rear-connecting wall of the striking plate component connects with the rear-assembling flange of the sidewall the rear-assembling component. Accordingly, an assembled reliability between the striking plate component and the rear-assembling component can be insured by the engagement of the engaging stepped end with the rear-assembling flange.

The golf club head in accordance with an aspect of the present invention includes a striking plate component and a rear-assembling component mechanically connected thereto. The striking plate component provides with a striking face and a rear-connecting wall. The rear-connecting wall is bent rearward and extended a rearward extended length from the striking face. The rear-assembling component provides with a sidewall corresponding to the rear-connecting wall of the striking plate component. In assembling, the rear-connecting wall of the striking plate component connects with the sidewall of the rear-assembling component such that the rear-connecting wall separates the striking face from the rear-assembling component for permitting elastic deformation.

In a separate aspect of the present invention is that the striking plate component further provides with an upstanding bent edge bent inwardly from the rear-connecting wall for connecting with the rear-assembling component.

In a further separate aspect of the present invention is that the rear-assembling component further provides with a rear-assembling flange for connecting with the rear-connecting wall of the striking plate component.

In a yet further separate aspect of the present invention is that the rear-connecting wall of the striking plate component provides with an engaging stepped end connecting with the rear-assembling flange of the sidewall the rear-assembling component.

Further scope of the applicability of the present invention will become apparent from the detailed description given hereinafter. However, it should be understood that the detailed description and specific examples, while indicating preferred embodiments of the invention, are given by way of illustration only, since various will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 3:
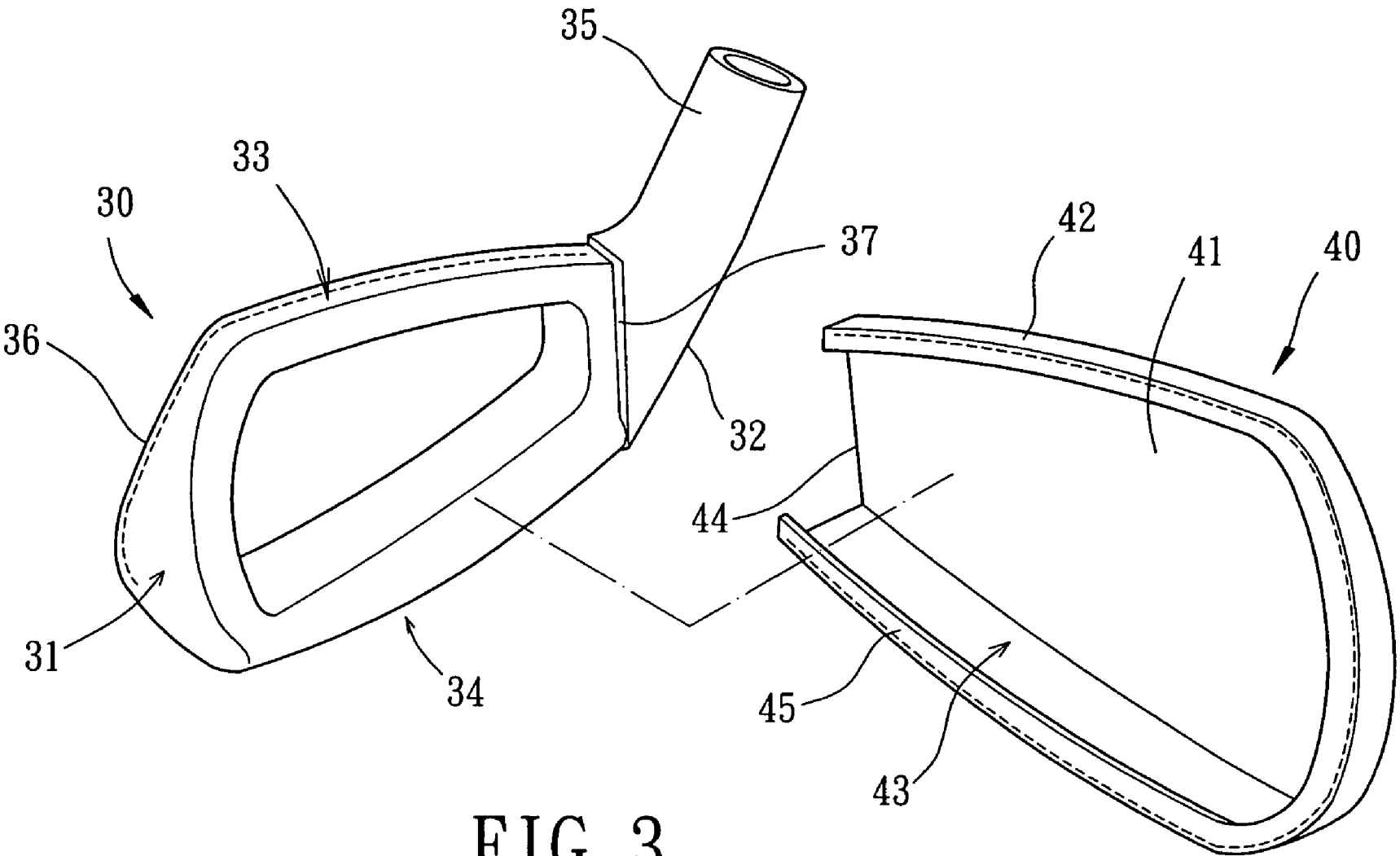
FIG. 3 is an exploded perspective view of a golf club head having a connecting structure for a high degree of flexibility in accordance with a first embodiment of the present invention.

Referring to FIG. 3, a golf club head generally includes a club head body component (i.e. rear-assembling component) designated numeral 30 and a striking plate component designated numeral 40 connected with the club head body component 30. The golf club head can be selected from a group consisting of a wood-type club head, an iron-type club head, a utility-type club head and a putter-type club head. In the following embodiments, the connecting structure of the golf club head in accordance with the present invention shall be only applied to the iron-type club head. It will be understood that the cover plate structure applied to the wood-type, utility-type or putter-type club head in accordance with the present invention is omitted.

Figure 4:
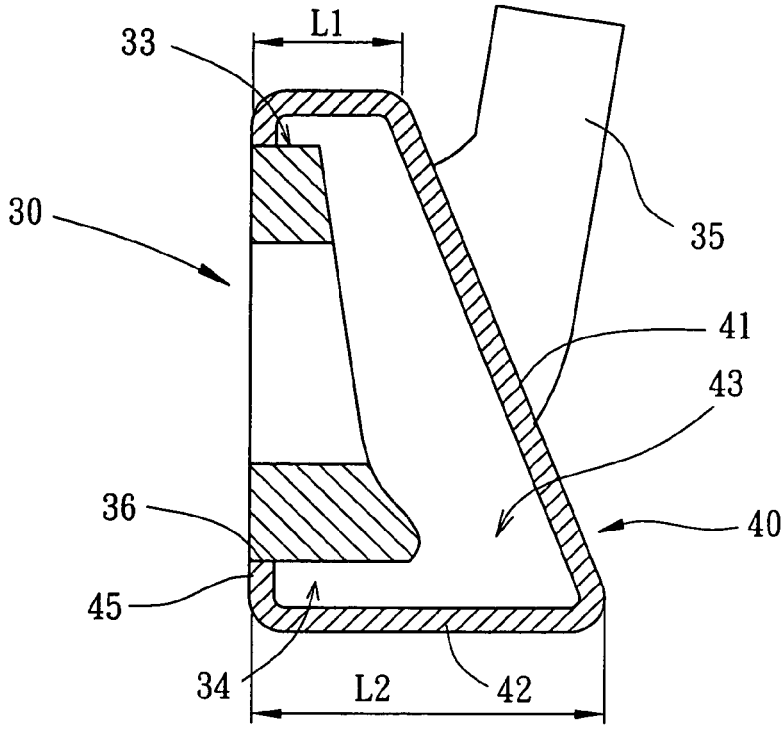
FIG. 4 is a cross-sectional perspective view of the golf club head having the connecting structure in accordance with the first embodiment of the present invention.

Turning now to FIGS. 3 and 4, construction of the club head body component 30 shall be described in detail. The club head body component is a monolithic body, and constructed from materials selected from a group consisting of metal, nonmetal and alloy. In particular, the club head body component 30 so constructed from nonmetal can be formed either from similar or dissimilar materials. In the first embodiment, the club head body component 30 includes a toe portion 31, a heel portion 32, a crown portion 33, a sole portion 34, a hosel portion 35, a connecting rear-end portion 36 and a lateral wall portion 37. Each configuration of the toe portion 31, the heel portion 32, the crown portion 33, the sole portion 34 and the hosel portion 35 has an ordinary or common structure of the art. The club head body component 30 further includes an opening (not labeled) which serves to form a club head body. The connecting rear-end portion 36 is successively disposed on peripheries of the crown portion 33, the toe portion 31 and the sole portion 34. The lateral wall portion 37 is extended on the heel portion 32 for connecting with the striking plate component 40 which will be further described more fully below. Typically, lower dimensions of the club head body component 30 are designed for being greater than upper dimensions thereof in aiding to lower a center of gravity.

Still referring to FIGS. 3 and 4, construction of the striking plate component 40 shall be described in detail. In the first embodiment, the striking plate component 40 is a one-piece member and constructed from materials selected from a group consisting of metal, nonmetal and alloy. In particular, the striking plate component 40 so constructed from nonmetal can be formed either from similar or dissimilar materials. The striking plate component 40 includes a striking face 41, a rear-connecting wall 42, a rear interior 43, a lateral notch 44 and an upstanding bent edge 45. Preferably, the striking plate component 40 has a U-shaped transverse section for permitting elastic deformation. Generally, the striking face 41 presents a substantially flat surface at its front side, and a relatively thick region at its center (i.e. sweet spot). The rear-connecting wall 42 is bent rearward and extended a rearward extended length from the striking face 41 such that the striking plate component 40 has a U-shaped transverse section. The rear-connecting wall 42 can be varied in rearward extended lengths to constitute a common shape of the golf club head. Typically, a rearward extended length "L1" of a crown portion of the rear-connecting wall 42 is less than a rearward extended length "L2" of a sole portion of the rear-connecting wall 42. A toe portion of the rear-connecting wall 42 is designed for varying in rearward extended lengths. For example, if the rear-connecting wall 42 of the striking plate component 40 is proximate to the crown portion, the rearward extended length of the rear-connecting wall 42 is relatively shorter. But if the rear-connecting wall 42 of the striking plate component 40 is proximate to the sole portion, the rearward extended length of the rear-connecting wall 42 is relatively greater. Furthermore, the rear-connecting wall 42 delimits the rear interior 43 which is in communication with the lateral notch 44. The lateral notch 44 is proximate to a heel portion in corresponding to the lateral wall portion 37 of the club head body component 30. The upstanding bent edge 45 is substantially bent inwardly and extended from the rear-connecting wall 42 for connecting with a sidewall of the club head body component 30.

Still referring to FIGS. 3 and 4, the assembling operation of the club head body component 30 and the striking plate component 40 shall be described in detail. In assembling, the club head body component 30 servers as a rear-assembling component and to be received in the rear interior 43 of the striking plate component 40. When this occurs, the upstanding bent edge 45 of the striking plate component 40 engages with the connecting rear-end portion 36 of the sidewall of the club head body component 30. Meanwhile, the lateral notch 44 of the striking plate component 40 engages with the lateral wall portion 37 of the club head body component 30. This results in the striking plate component 40 initially connected with the club head body component 30 in the intended manner. Alternatively, the striking plate component 40 can be securely connected with the club head body component 30 by adhesive, brazing, welding or some other suitable connecting means. After the club head body component 30 is so connected with the striking plate component 40, the club head body component 30 is inserted into the rear interior 43 of the striking plate component 40. Advantageously, the crown portion 33, the toe portion 31 and the sole portion 34 of the club head body component 30 is not in contact with the rear-connecting wall 42 of the striking plate component 40 in permitting elastic deformation. Consequently, there exists a buffer space between each of the crown portion 33, the toe portion 31 and the sole portion 34 of the club head body component 30 and the rear-connecting wall 42 of the striking plate component 40. As a result, the club head body component 30 cannot directly affect elastic deformation of the striking face 41 of the striking plate component 40 while striking a golf ball (not shown). Adjusting the rearward extended length of the rear-connecting wall 42 of the striking plate component 40 alleviates such undesired affections, due to the club head body component 30. The club head body component 30 and the striking plate component 40 so connected with each other in accordance with the present invention permits freely varying or increasing the rearward extended length of the rear-connecting wall 42 of the striking plate component 40. The design of the club head body component 30, however, cannot limit the striking plate component 40 in increasing the rearward extended length of the rear-connecting wall 42 such that elastic deformation of abilities of the striking plate component 40 is insured.

Figure 1:
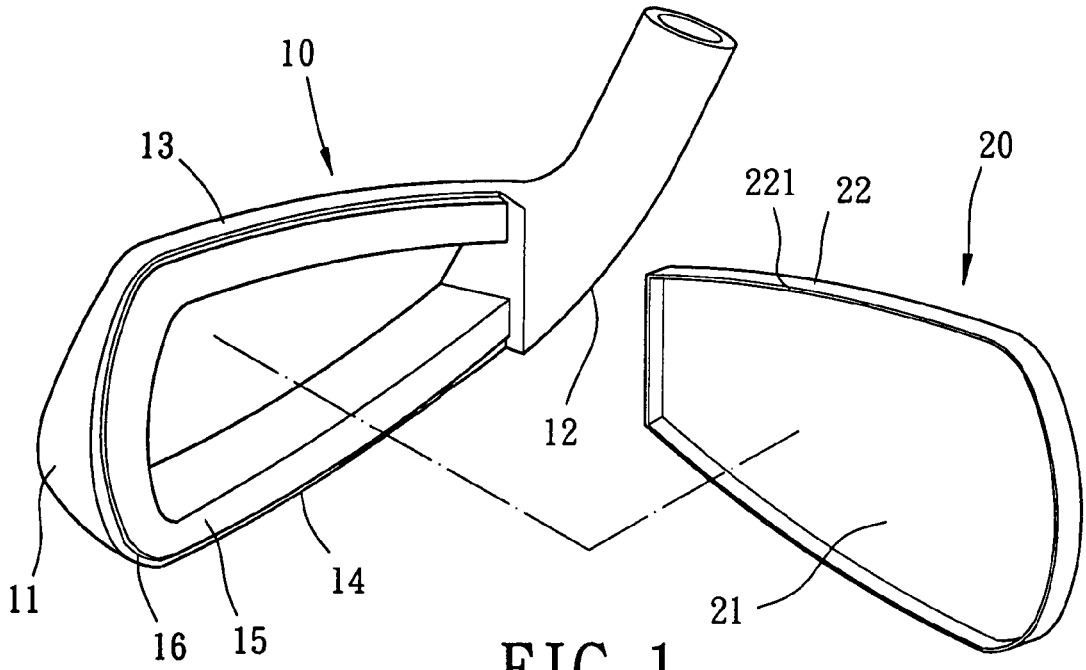
FIG. 1 PRIOR ART
FIG. 1 is an exploded perspective view of a conventional golf club head in accordance with the prior art.
Figure 2:
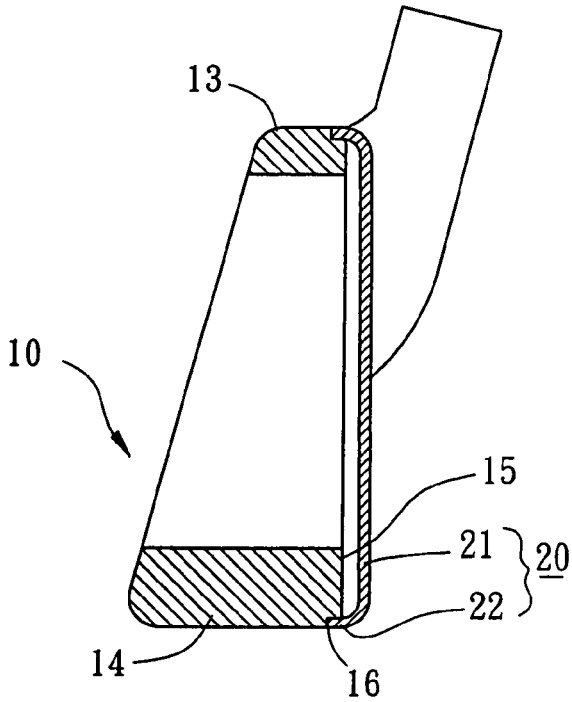
FIG. 2 PRIOR ART
FIG. 2 is a cross-sectional view of the conventional golf club head in accordance with the prior art.
Figure 5:
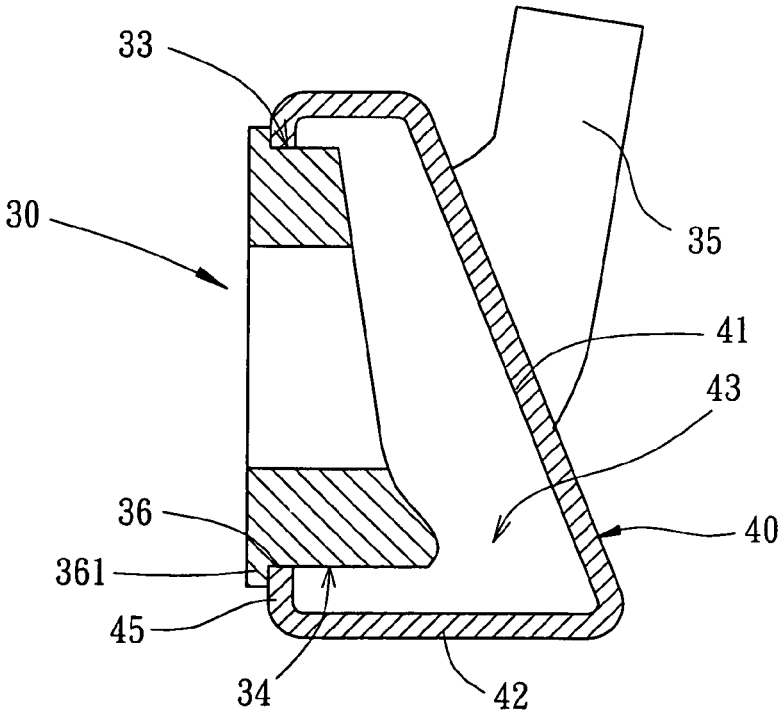
FIG. 5 is a cross-sectional view of the golf club head having the connecting structure in accordance with a second embodiment of the present invention.

Turning now to FIG. 5, reference numerals of the second embodiment of the present invention have applied the identical numerals of the first embodiment, as shown in FIG. 1. The construction of the golf club head structure in accordance with the second embodiment of the present invention has similar configuration and same function as that of the golf club head structure of the first embodiment and detailed descriptions may be omitted.

Still referring to FIG. 5, in comparison with the first embodiment, the connecting rear-end portion 36 of the club head body component 30 of the second embodiment further provides with a rear-assembling flange 361 for connecting with the upstanding bent edge 45 of the rear-connecting wall 42 of the striking plate component 40. The rear-assembling flange 361 is projected radially outward from the connecting rear-end portion 36 of the club head body component 30. Advantageously, this results in an increase of assembled reliability of the club head body component 30 and the striking plate component 40. In the second embodiment, the design of the rear-assembling flange 361 of the club head body component 30, however, cannot limit the striking plate component 40 in increasing the rearward extended length of the rear-connecting wall 42.

Figure 6:
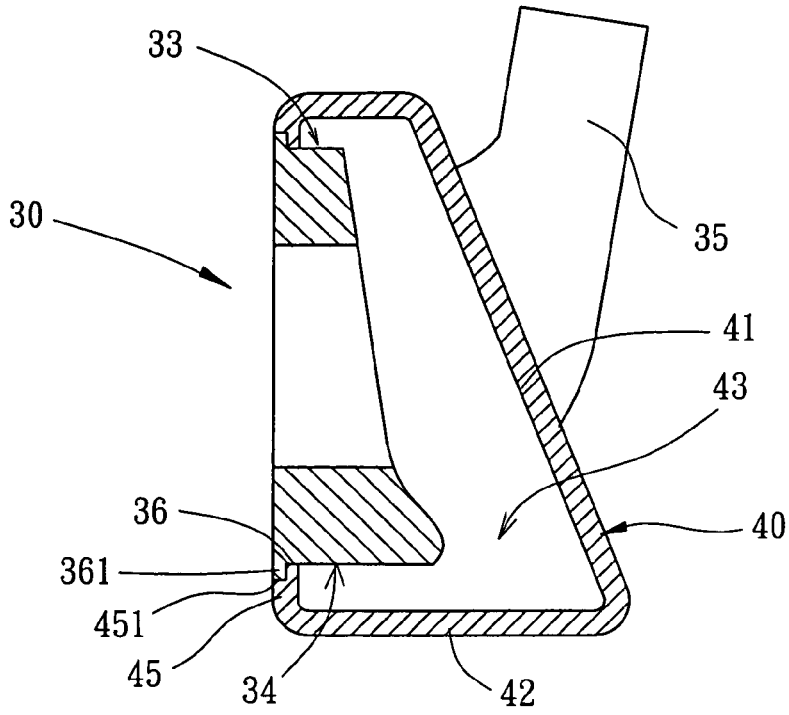
FIG. 6 is a cross-sectional view of the golf club head having the connecting structure in accordance with a third embodiment of the present invention.

Turning now to FIG. 6, reference numerals of the third embodiment of the present invention have applied the identical numerals of the second embodiment, as shown in FIG. 5. The construction of the golf club head structure in accordance with the third embodiment of the present invention has similar configuration and same function as that of the golf club head structure of the second embodiment and detailed descriptions may be omitted.

Still referring to FIG. 6, in comparison with the second embodiment, the rear-connecting wall 42 of the striking plate component 40 of the third embodiment provides with an engaging stepped end 451 connecting with the rear-assembling flange 361 of the sidewall of the club head body component 30. The engagement of the rear-assembling flange 361 of the club head body component 30 with the engaging stepped end 451 of the striking plate component 40. This results in an increase of an assembled reliability between the striking plate component 40 and the club head body component 30. The engagement of the rear-assembling flange 361 with the engaging stepped end 451, however, cannot limit the striking plate component 40 in increasing the rearward extended length of the rear-connecting wall 42 such that elastic deformation of abilities of the striking plate component 40 is insured.

Figure 7:
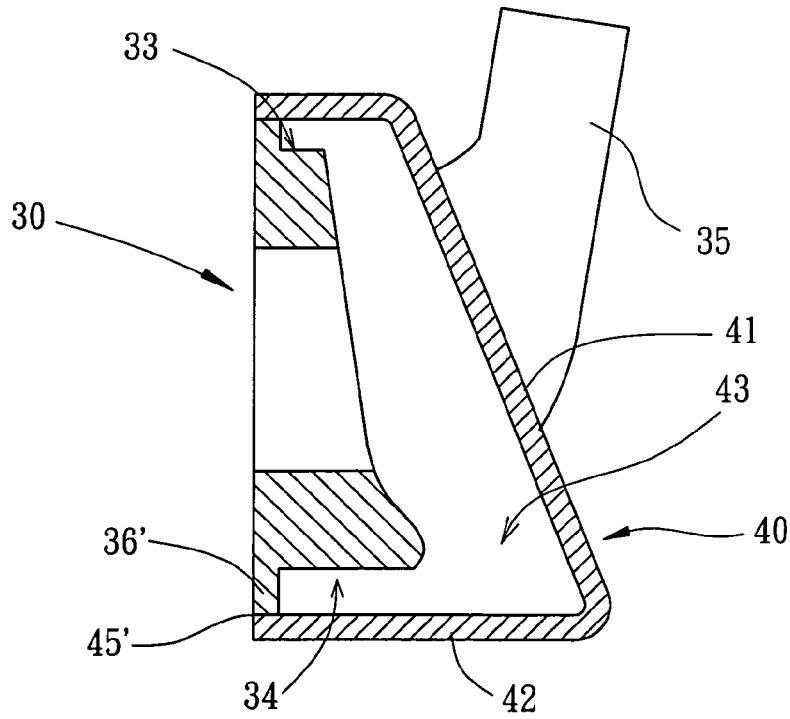
FIG. 7 is a cross-sectional view of the golf club head having the connecting structure in accordance with a fourth embodiment of the present invention.

Turning now to FIG. 7, reference numerals of the fourth embodiment of the present invention have applied the identical numerals of the second embodiment, as shown in FIG. 5. The construction of the golf club head structure in accordance with the fourth embodiment of the present invention has similar configuration and same function as that of the golf club head structure of the second embodiment and detailed descriptions may be omitted.

Still referring to FIG. 7, in comparison with the second embodiment, the rear-assembling flange 36' of the club head body component 30 of the fourth embodiment directly connects with an inner circumference 45' of the rear-connecting wall 42 of the striking plate component 40. Referring back to FIG. 5, the rear-connecting wall 42 of the striking plate component 40 of the fourth embodiment does not provide with the upstanding bent edge 45. The removal of upstanding bent edge 45 from the rear-connecting wall 42, however, cannot limit the striking plate component 40 in increasing the rearward extended length of the rear-connecting wall 42 such that elastic deformation of abilities of the striking plate component 40 is insured.

Figure 8:
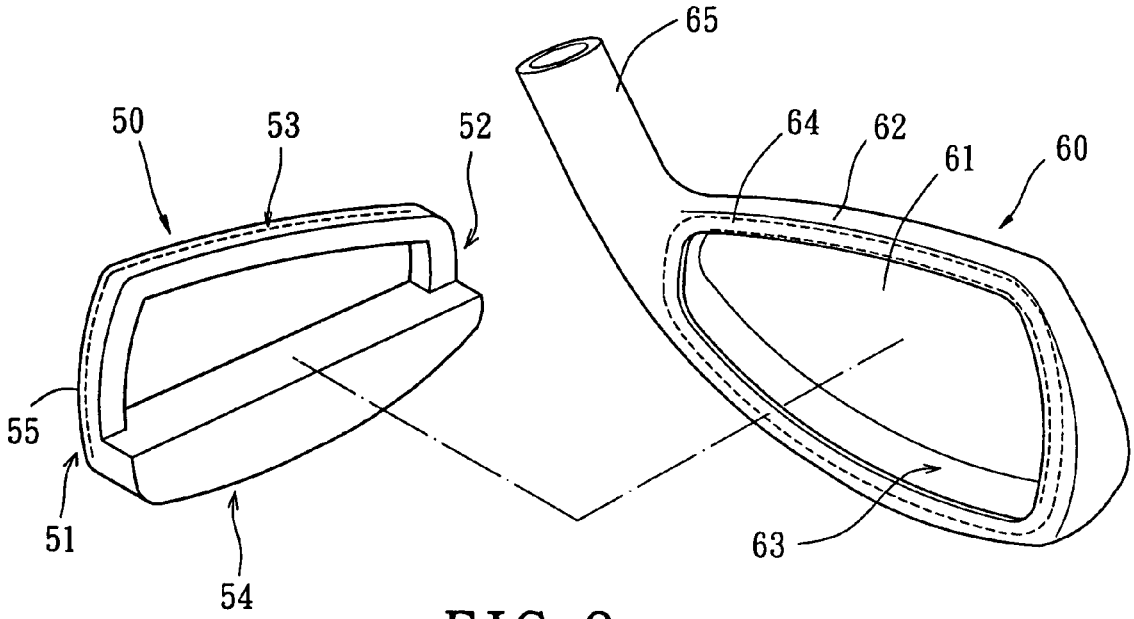
FIG. 8 is an exploded perspective view of the golf club head the connecting structure in accordance with the fifth embodiment of the present invention.
Figure 9:
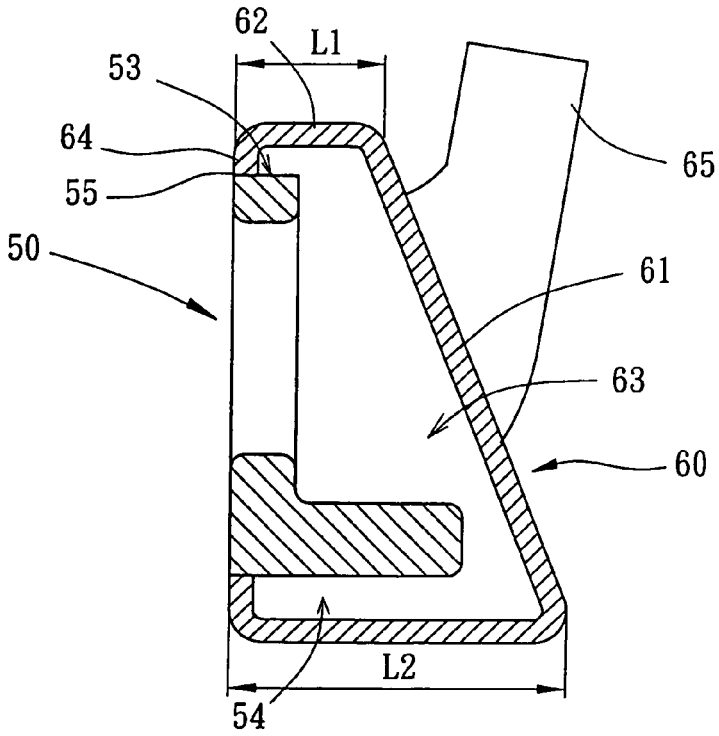
FIG. 9 is a cross-sectional view of the golf club head having the connecting structure in accordance with the fifth embodiment of the present invention.

Turning now to FIGS. 8 and 9, reference numerals of the fifth embodiment of the present invention have applied the identical numerals of the first embodiment, as shown in FIG. 1. The construction of the golf club head structure in accordance with the fifth embodiment of the present invention has similar configuration and same function as that of the golf club head structure of the first embodiment and detailed descriptions may be omitted.

Still referring to FIGS. 8 and 9, in comparison with the first embodiment, a weight component (i.e. rear-assembling component) 50 of the fifth embodiment connects with a striking plate component 60. The weight component 50 is constructed from materials having a relatively high degree of specific gravity with respect to that of the striking plate component 60.

Construction of the weight component 50 shall be described in detail with reference to FIGS. 8 and 9. In the fifth embodiment, the weight component 50 includes a first side portion 51, a second side portion 52, a top portion 53, a bottom portion 54 and a connecting rear-end portion 55. The connecting rear-end portion 55 is successively disposed on peripheries of the top portion 53, the first side portion 51, the bottom portion 54 and the second side portion 52. Typically, lower dimensions of the weight component 50 are designed for being greater than upper dimensions thereof in aiding to lower a center of gravity.

Construction of the striking plate component 60 shall be described in detail with reference to FIGS. 8 and 9. In the fifth embodiment, the striking plate component 60 is constructed from materials selected from a group consisting of metal, nonmetal and alloy which has relatively low specific gravity. The striking plate component 60 includes a striking face 61, a rear-connecting wall 62, a rear interior 63, an upstanding bent edge 64 and a hosel portion 65. Besides, the striking plate component 60 further constitutes a toe portion, a heel portion, a blade portion and a sole portion (not labeled) which are corresponding to the first side portion 51, the second side portion 52, the top portion 53 and the bottom portion 54 of the weight component 50. The rear-connecting wall 62 is bent rearward and extended a rearward extended length from the striking face 61 such that the striking plate component 60 has a U-shaped transverse section. Typically, a rearward extended length "L1" of the crown portion of the rear-connecting wall 62 is lesser than a rearward extended length "L2" of a sole portion of the rear-connecting wall 62. Furthermore, the rear-connecting wall 62 delimits the rear interior 63 in which to receive the weight member 50. The upstanding bent edge 64 is substantially bent inwardly and extended from the rear-connecting wall 62 for connecting with a sidewall of the weight component 50. The hosel portion 65 is integrally formed on the heel portion of the striking plate component 60.

In an alternative embodiment, the connecting rear-end portion 55 of the weight component 50 and the upstanding bent edge 64 of striking plate component 60 are interchanged.

Still referring to FIG. 9, in assembling, the weight component 50 servers as a rear-assembling component and to be received in the rear interior 63 of the striking plate component 60. When this occurs, the upstanding bent edge 64 of the striking plate component 60 engages with the connecting rear-end portion 55 of the sidewall of the weight component 50. This results in the striking plate component 60 initially connected with the weight component 50 in the intended manner. Alternatively, the striking plate component 60 can be securely connected with the weight component 50 by adhesive, brazing, welding or some other suitable connecting means. After the weight component 50 is so connected with the striking plate component 60, the weight component 50 is inserted into the rear interior 63 of the striking plate component 60. Advantageously, the top portion 53, the first side portion 51, the bottom portion 54 and the second side portion 52 of the weight component 50 is not in contact with the rear-connecting wall 62 of the striking plate component 60 in permitting elastic deformation. Consequently, there exists a buffer space between each of the top portion 53, the first side portion 51, the second side portion 52 and the bottom portion 54 of the weight component 50 and the rear-connecting wall 62 of the striking plate component 60. As a result, the weight component 50 cannot directly affect elastic deformation of the striking face 61 of the striking plate component 60 while striking a golf ball (not shown). The weight component 50 and the striking plate component 60 so connected with each other in accordance with the present invention permits freely varying or increasing the rearward extended length of the rear-connecting wall 62 of the striking plate component 60. The design of the weight component 50, however, cannot limit the striking plate component 60 in increasing the rearward extended length of the rear-connectling wall 62 such that elastic deformation of abilities of the striking plate component 60 is insured.

Referring back to FIG. 5, in an alternative embodiment, the weight component 50 further provides with a rear-assembling flange (not shown) projected radially outward from the connecting rear-end portion 55 of the weight component 50. Referring back to FIG. 6, in an alternative embodiment, the upstanding bent edge 64 of the striking plate component 60 further provides with an engaging stepped end (not shown) for connecting with the rear-assembling flange of the weight component 50. This results in an increase of an assembled reliability between the striking plate component 60 and the weight component 50.

Figure 10:
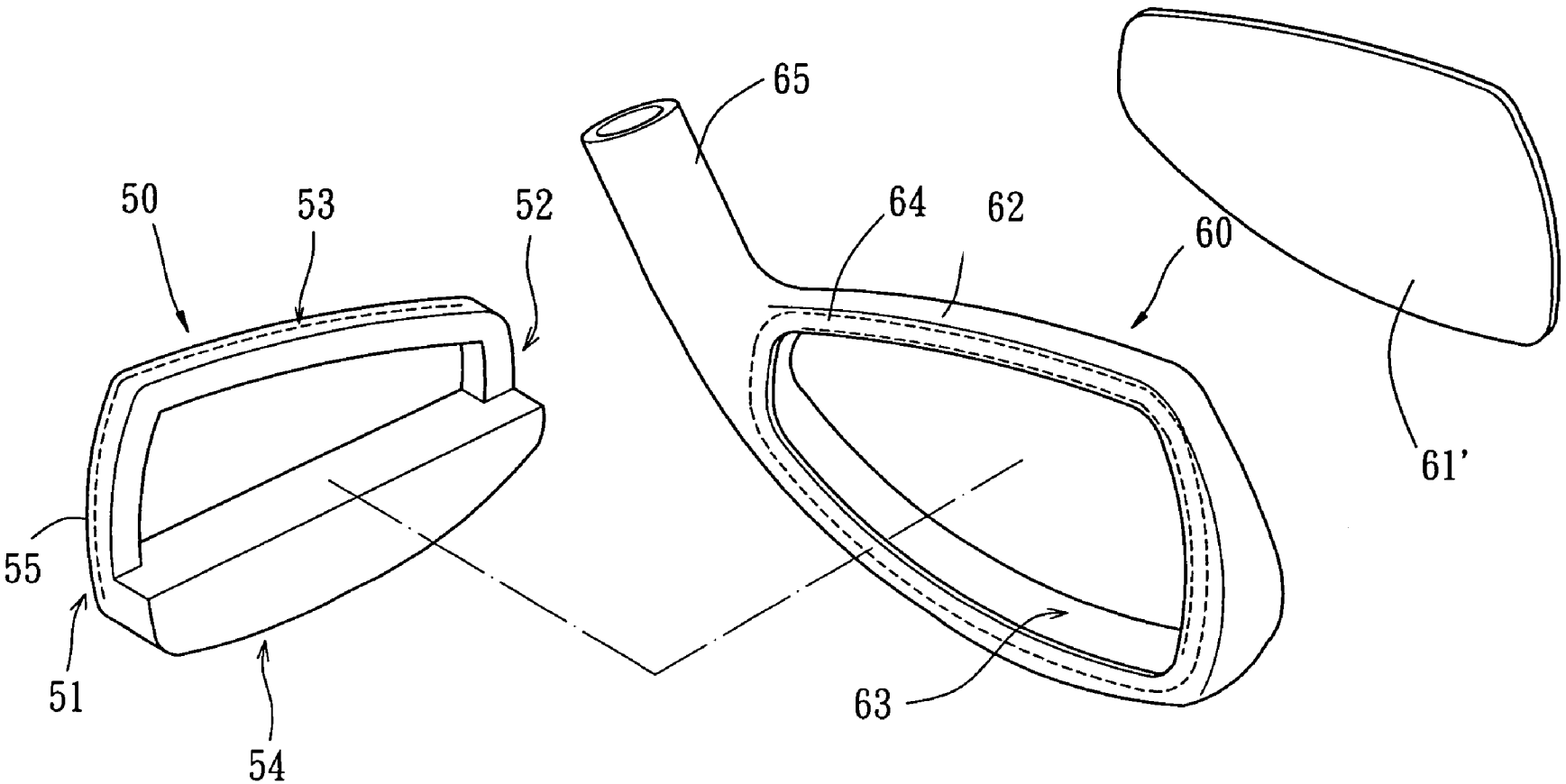
FIG. 10 is an exploded perspective view of the golf club head having the connecting structure in accordance with a sixth embodiment of the present invention.

Turning now to FIG. 10, reference numerals of the sixth embodiment of the present invention have applied the identical numerals of the fifth embodiment, as shown in FIG. 8. The construction of the golf club head structure in accordance with the sixth embodiment of the present invention has similar configuration and same function as that of the golf club head structure of the fifth embodiment and detailed descriptions may be omitted.

Still referring to FIG. 10, in comparison with the fifth embodiment, the striking plate component 60 of the sixth embodiment includes a striking face 61'. The striking plate component 60 and the striking face 61' are formed separately to constitute a two-piece component, and made of dissimilar metals such that elastic deformation of such a configuration of the striking face 61' is insured. When the upstanding bent edge 64 of the striking plate component 60 engages with the connecting rear-end portion 55 of the sidewall of the weight component 50, the weight member 50 is spaced from the rear-connecting wall 62 of the striking plate component 60. As a result, the weight component 50 cannot directly affect elastic deformation of the striking face 61' of the striking plate component 60 while striking a golf ball (not shown). The weight component 50 and the striking plate component 60 so connected with each other in accordance with the present invention permits freely varying or increasing the rearward extended length of the rear-connecting wall 62 of the striking plate component 60.

Figure 11:
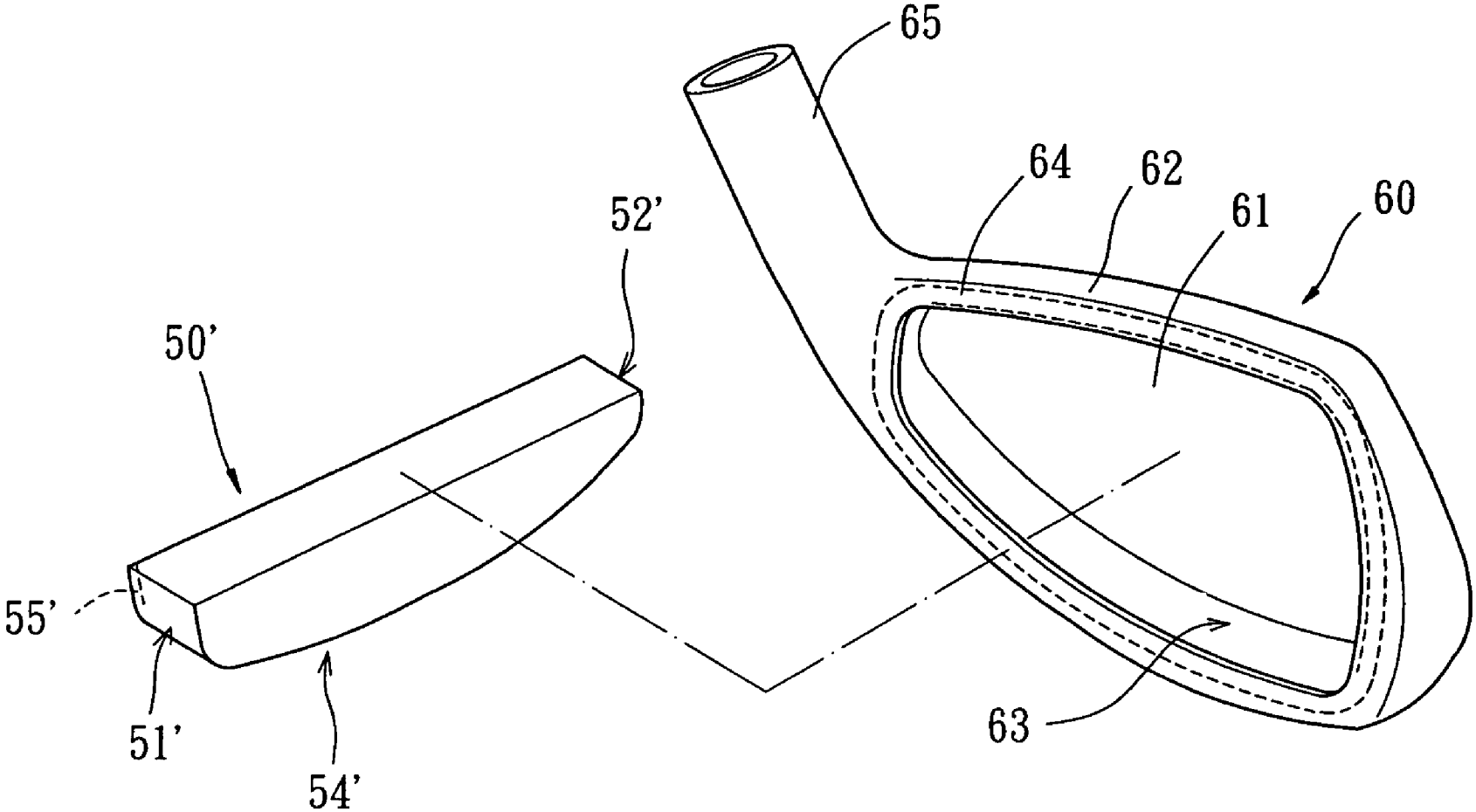
FIG. 11 is a cross-sectional view of the golf club head having the connecting structure in accordance with the seventh embodiment of the present invention.

Turning now to FIG. 11, reference numerals of the seventh embodiment of the present invention have applied the identical numerals of the fifth embodiment, as shown in FIG. 8. The construction of the golf club head structure in accordance with the seventh embodiment of the present invention has similar configuration and same function as that of the golf club head structure of the fifth embodiment and detailed descriptions may be omitted.

Still referring to FIG. 11, in comparison with the fifth embodiment, the weight component 50' of the seventh embodiment includes a first side portion 51', a second side portion 52', a bottom portion 54' and a connecting rear-end portion 55'. It will be understood that a top portion of the weight component 50' is omitted in lowering a center of gravity of the golf club head. When the striking plate component 60 connects with the weight component 50', there exists a buffer space between the bottom portion 54' of the weight component 50' and the rear-connecting wall 62 of the striking plate component 60.

In an alternative embodiment, the weight component 50' can be designed for disposing at a position proximate to one of the toe portion, the heel portion and the crown portion of the striking plate component 60 according to the need.

When the upstanding bent edge 64 of the striking plate component 60 engages with the connecting rear-end portion 55' of the sidewall of the weight component 50', the weight member 50' is spaced from the rear-connecting wall 62 of the striking plate component 60. As a result, the weight component 50' cannot directly affect elastic deformation of the striking face 61 of the striking plate component 60 while striking a golf ball (not shown). The weight component 50' and the striking plate component 60 so connected with each other in accordance with the present invention permits freely varying or increasing the rearward extended length of the rear-connecting wall 62 of the striking plate component 60.

As has been discussed above, referring back to FIG. 1, the conventional striking plate portion 20 provides with the annular wall 22 in increasing elastic deformation; even so, the striking plate portion 20 so connected with the club head body portion 10 limits a length of the annular wall 22. As a result, the performance of elastic deformation of the striking plate portion 20 may be specifically affected.

Conversely, the rear-connecting wall of the striking plate component in accordance with the present invention, as shown in FIGS. 3, 5-8 and 9-11, connects with the rear-assembling component by means of an upstanding bent edge or a rear-assembling flange. Consequently, elastic deformation of the striking plate component is insured, and an assembled relationship between the rear-assembling component and the striking plate component is also insured.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. A golf club head having a connecting structure, comprising:

a striking plate component including a striking face, a rear-connecting wall and a rear interior, the rear-connecting wall having a sole portion and a crown portion and being bent rearward and extended a rearward extended length from the striking face, with the rearward extended length of the sole portion being greater than that of the crown portion, with the rear-connecting wall delimiting the rear interior;

an upstanding bent edge substantially bent inwardly and extended from the rear-connecting wall of the striking plate component; and a rear-assembling component including a sidewall and a connecting rear-end portion, the connecting rear-end portion being disposed on the sidewall;

wherein when the upstanding bent edge engages with the connecting rear-end portion of the rear-assembling component, the rear-connecting wall separates the striking face from the rear-assembling component such that elastic deformation of the striking face is insured.

2. The golf club head having the connecting structure as defined in claim 1, wherein the rear-assembling component is constructed from a club head body component on which providing with the connecting rear-end portion.

3. The golf club head having the connecting structure as defined in claim 2, wherein the club head body component includes a lateral wall portion extended on a heel portion; the striking plate portion includes a lateral notch corresponding to the lateral wall portion of the club head body component.

4. The golf club head having the connecting structure as defined in claim 1, wherein the rear-assembling component is constructed from a weight component on which providing with the connecting rear-end portion.

5. The golf club head having the connecting structure as defined in claim 1, wherein the rear-assembling component is integrally formed with a hosel portion.

6. The golf club head having the connecting structure as defined in claim 1, wherein the striking plate component is integrally formed with a hosel portion.

7. The golf club head having the connecting structure as defined in claim 1, wherein lower dimensions of the rear-assembling component is greater than upper dimensions thereof in aiding to lower a center of gravity.

8. The golf club head having the connecting structure as defined in claim 1, wherein the connecting rear-end portion of the rear-assembling component further includes a rear-assembling flange to engage with the upstanding bent edge.

9. The golf club head having the connecting structure as defined in claim 1, wherein the connecting rear-end portion of the rear-assembling component further includes a rear-assembling flange; the striking plate component including an engaging stepped end to engage with the rear-assembling flange of the rear-assembling component.

10. The golf club head having the connecting structure as defined in claim 1, wherein the striking plate component and the striking face are formed separately or integrally.

11. A golf club head having a connecting structure, comprising:

a striking plate component including a striking face, an elastic deformation portion and a first connecting portion, the elastic deformation portion being constructed from a rear-connecting wall and connecting with the striking face, and the first connecting portion connecting with the elastic deformation portion, with the rear-connecting wall having a rearward extended length of a sole portion being greater than that of a crown portion; and a rear-assembling component including a second connecting portion to connect with the first connecting portion of the striking plate component so as to constitute the golf club head;

wherein the first connecting portion of the striking plate component separates the striking face and the elastic deformation portion from the rear-assembling component such that elastic deformation of the striking face is insured.

12. The golf club head having the connecting structure as defined in claim 11, wherein the first connecting portion is substantially bent inwardly and extended from the rear-connecting wall.

13. The golf club head having the connecting structure as defined in claim 11, wherein the first connecting portion is constructed from an inner circumference of the rear-connecting wall.

14. The golf club head having the connecting structure as defined in claim 11, wherein the rear-assembling component is constructed from a club head body component, and the second connecting portion is constructed from a connecting rear-end portion.

15. The golf club head having the connecting structure as defined in claim 14, wherein the club head body component includes a lateral wall portion extended on a heel portion; the striking plate portion includes a lateral notch corresponding to the lateral wall portion of the club head body component.

16. The golf club head having the connecting structure as defined in claim 11, wherein the rear-assembling component is constructed from a club head body component, and the second connecting portion is constructed from a rear-assembling flange.

17. The golf club head having the connecting structure as defined in claim 16, wherein the club head body component includes a lateral wall portion extended on a heel portion; the striking plate portion includes a lateral notch corresponding to the lateral wall portion of the club head body component.

18. The golf club head having the connecting structure as defined in claim 11, wherein the rear-assembling component is constructed from a weight component, and the second connecting portion is constructed from a connecting rear-end portion.

19. The golf club head having the connecting structure as defined in claim 11, wherein the rear-assembling component is constructed from a weight component, and the second connecting portion is constructed from a rear-assembling flange.

20. The golf club head having the connecting structure as defined in claim 11, wherein the rear-assembling component is integrally formed with a hosel portion.

21. The golf club head having the connecting structure as defined in claim 11, wherein the striking plate component is integrally formed with a hosel portion.

22. The golf club head having the connecting structure as defined in claim 11, wherein lower dimensions of the rear-assembling component is greater than upper dimensions thereof in aiding to lower a center of gravity.

23. The golf club head having the connecting structure as defined in claim 11, wherein the striking plate component and the striking face is formed separately or integrally.

* * * * *